US010837460B2

(12) United States Patent
Ediger et al.

(10) Patent No.: US 10,837,460 B2
(45) Date of Patent: Nov. 17, 2020

(54) FAN DESIGN WITH AN IMPACT ABSORBING STRUCTURE

(71) Applicant: Vornado Air, LLC, Andover, KS (US)

(72) Inventors: Glen W. Ediger, North Newton, KS (US); Brian M. Cartwright, Wichita, KS (US); Gary Israel, Andover, KS (US); Gregory Pease, Andover, KS (US); Cooper Phillips, Wichita, KS (US)

(73) Assignee: Vornado Air, LLC, Andover, KS (US)

( * ) Notice: Subject to any disclaimer, the term of this patent is extended or adjusted under 35 U.S.C. 154(b) by 174 days.

(21) Appl. No.: 16/045,638

(22) Filed: Jul. 25, 2018

(65) Prior Publication Data

US 2019/0048894 A1 Feb. 14, 2019

Related U.S. Application Data

(60) Provisional application No. 62/544,585, filed on Aug. 11, 2017.

(51) Int. Cl.

| | |
|---|---|
| ***F04D 29/66*** | (2006.01) |
| ***F04D 29/60*** | (2006.01) |
| ***F04D 19/00*** | (2006.01) |
| ***F04D 29/70*** | (2006.01) |
| ***F04D 29/40*** | (2006.01) |

(52) U.S. Cl.

CPC ..... *F04D 29/668* (2013.01); *F04D 19/002* (2013.01); *F04D 29/403* (2013.01); *F04D 29/601* (2013.01); *F04D 29/703* (2013.01)

(58) Field of Classification Search

CPC .... F04D 29/668; F04D 19/002; F04D 29/403; F04D 29/601; F04D 29/703

See application file for complete search history.

(56) References Cited

U.S. PATENT DOCUMENTS

| | | | | |
|---|---|---|---|---|
| 1,099,698 A * | 6/1914 | Glotfelty | ..... | A47G 25/10 211/30 |
| 2,100,994 A * | 11/1937 | Cohen | ..... | F04D 29/703 415/121.2 |
| 2,954,198 A * | 9/1960 | Lindberg | ..... | F04D 29/646 248/185.1 |
| 4,799,858 A * | 1/1989 | Shin-Chin | ..... | F04D 29/646 248/231.51 |

(Continued)

*Primary Examiner* — Courtney D Heinle
*Assistant Examiner* — Eric J Zamora Alvarez

(57) ABSTRACT

The present invention is related to anAn improved fan design with an impact absorbing structure is disclosed. In one example embodiment, the improved fan design may include a lower fan assembly connected to an upper fan assembly using a mounting bracket. The lower fan assembly may include a fan base having multiple supporting legs which are rotatably connected to the lower fan assembly. The upper fan assembly may include a fan motor and fan blades enclosed within a protective structure. In one embodiment, the protective structure of the present invention may include an outer fan cover, a fan grille, an external cage, and a perimeter shock absorbing ring extending around the the outer fan cover. According to another aspect, the perimeter shock absorbing ring may include an inner surface, an inner absorption layer, and an outer surface. The inner absorption layer may optionally include one or more flexible ribs.

5 Claims, 9 Drawing Sheets

(56) References Cited

U.S. PATENT DOCUMENTS

| | | | | |
|---|---|---|---|---|
| 6,364,618 | B1 * | 4/2002 | Moreno | F04D 29/703<br>403/13 |
| 6,682,308 | B1 * | 1/2004 | Fei | F04D 29/403<br>415/213.1 |
| 8,152,453 | B2 * | 4/2012 | Oleson | F04D 25/088<br>415/126 |
| 8,734,109 | B2 * | 5/2014 | He | F04D 29/601<br>416/142 |
| 9,127,689 | B2 * | 9/2015 | Gammack | F04D 29/403 |
| 2005/0118045 | A1 * | 6/2005 | Elton | F04D 29/601<br>417/423.15 |

* cited by examiner

FAN DESIGN WITH AN IMPACT ABSORBING STRUCTURE

RELATED APPLICATIONS

The present application claims priority to U.S. Provisional Application No. 62/544,585 filed Aug. 11, 2017.

FIELD OF INVENTION

The present invention is related in general to an improved fan design, and in particular, to an improved fan design with an impact absorbing structure.

BACKGROUND OF THE INVENTION

In the modern world, fans are commonly used in a variety of locations and environments. Even though the components and inner workings of fans can be complex and sensitive, fans are commonly subjected to harsh treatment. Over time, fans subjected to these conditions can become mechanically inefficient, unreliable and even dangerous.

To protect fans against a variety of environmental conditions, a number of engineering solutions have been applied. Most notably, fans are commonly over designed so that the fan motor and blades can withstand the repeated mechanical shocks and bumps experienced in their use. Despite these attempts however, fans remain vulnerable to a wide variety of environmental hazards.

Based on the foregoing, the present invention provides an improved fan design with an impact absorbing structure. The present invention overcomes the short comings of the prior art by accomplishing this critical objective.

SUMMARY OF THE DISCLOSURE

To minimize the limitations found in the prior art, and to minimize other limitations that will be apparent upon the reading of the specifications, the preferred embodiment of the present invention provides an improved fan design with an impact absorbing structure.

According to an exemplary preferred embodiment, the improved fan design of the present invention includes a lower fan assembly connected to an upper fan assembly using a mounting bracket.

According to a further aspect of the present invention, the lower fan assembly preferably may include a fan base having multiple supporting legs which are preferably rotatably connected to the lower fan assembly.

According to a further aspect of the present invention, the upper fan assembly of the present invention may include a fan motor and fan blades enclosed within a protective structure. According to a further preferred embodiment, the protective structure of the present invention preferably includes an outer fan cover, a fan grille, an external cage and a perimeter shock absorbing ring extending around the circumference of the outer fan cover. According to a further aspect of the present invention, the perimeter shock absorbing ring may include an inner surface, an inner absorption layer and an outer surface. According to a further aspect of the present invention, the inner absorption layer may preferably include one or more flexible ribs.

According to a still further aspect of the present invention, the improved fan design of the present invention may preferably further include an impact absorbing mount which includes raised projections and a rear mounting surface. According to a further aspect of the present invention, the raised projections may preferably be hollow, circular projections which are perforated to allow for a connector to extend through to the rear mounting surface and to secure the inner fan assembly to the cage with the connector.

These and other advantages and features of the present invention are described with specificity so as to make the present invention understandable to one of ordinary skill in the art.

BRIEF DESCRIPTION OF THE DRAWINGS

Elements in the figures have not necessarily been drawn to scale in order to enhance their clarity and improve understanding of these various elements and embodiments of the invention. Furthermore, elements that are known to be common and well understood to those in the industry are not depicted in order to provide a clear view of the various embodiments of the invention, thus the drawings are generalized in form in the interest of clarity and conciseness. It should be understood that the scope of the present invention is intended to be limited solely by the appended claims.

DETAILED DESCRIPTION OF THE DRAWINGS

In the following discussion that addresses a number of embodiments and applications of the present invention, reference is made to the accompanying drawings that form a part hereof, and in which is shown by way of illustration specific embodiments in which the invention may be practiced. It is to be understood that other embodiments may be utilized and changes may be made without departing from the scope of the present invention.

Various inventive features are described below that can each be used independently of one another or in combination with other features. However, any single inventive feature may not address any of the problems discussed above or only address one of the problems discussed above. Further, one or more of the problems discussed above may not be fully addressed by any of the features described below.

Figure 1:
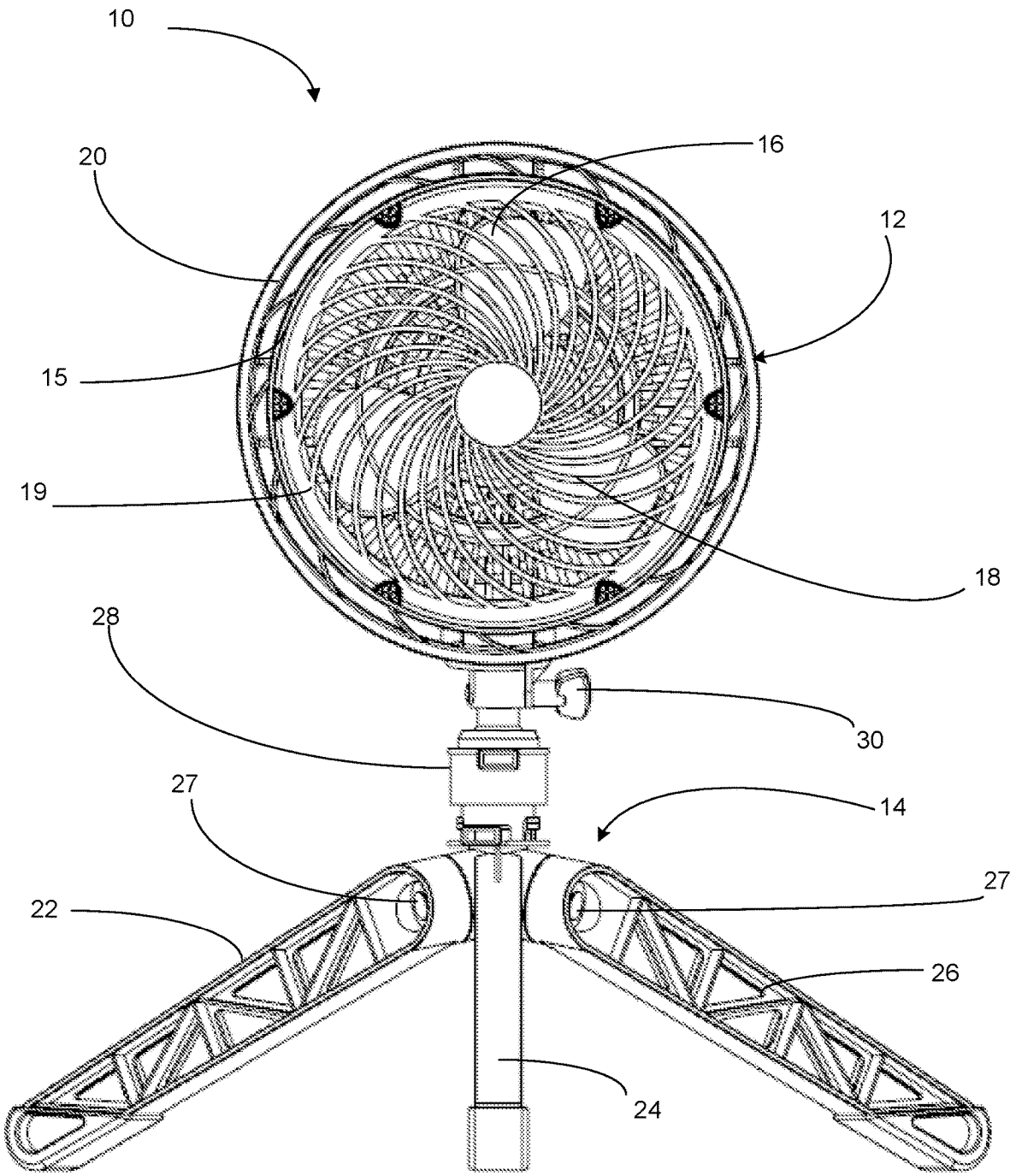
FIG. 1 shows a front view of a fan assembly in accordance with a first preferred embodiment of the present invention.

FIG. 1 illustrates a front view of a fan assembly 10 in accordance with a first preferred embodiment of the present invention. As shown in FIG. 1, the fan assembly 10 preferably includes an upper fan head 12 which is attached to a fan base 14. As further shown, in accordance with a further preferred embodiment the fan head 12 is preferably attached to the fan base 14 using a mounting bracket 28 which preferably includes an adjustable joint mechanism 30. Preferably, the adjustable joint mechanism 30 may be fully adjustable and may allow for tilt adjustment, fan head rotation and a variety of lockable positions. In accordance with a further preferred embodiment, the mounting bracket 28 may preferably be a bayonet mount or the like. As further shown, in accordance with a further preferred embodiment, fan base 14 preferably may be a fold-up base such as a three-legged fold up base or the like. As shown in FIG. 1, the exemplary fan base 14 may preferably include three supporting legs 22, 24, 26 which preferably are able to extend out and rotate from connecting joints 27.

With further reference to FIG. 1, the fan head 12 in accordance with a preferred embodiment of the present invention preferably includes a fan grille 18 which encloses the fan blades 16 of the fan assembly 10. As further shown, the fan grille 18 preferably includes an outer fan cover 15 and a number of fan veins 19 which are preferably formed and arranged to divide and direct the column of air created by the fan blades 16. In accordance with a further preferred embodiment, the fan head 12 preferably further includes a perimeter shock absorbing ring 20 which preferably extends around the circumference of the outer fan cover 15.

Figure 2:
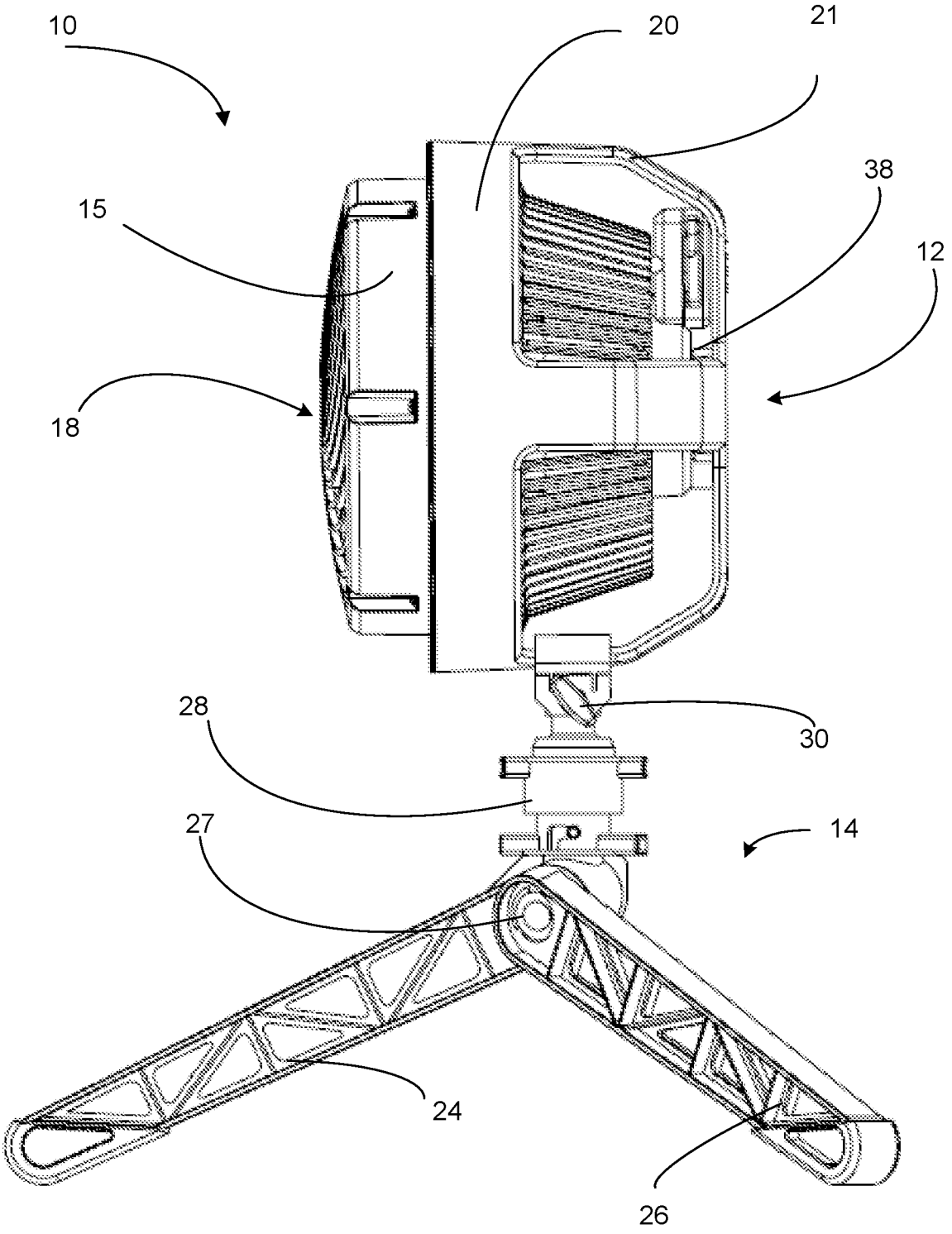
FIG. 2 shows a side-view of a fan assembly in accordance with a first preferred embodiment of the present invention.

Referring now to FIG. 2, a side-view of the fan assembly 10 in accordance with a first preferred embodiment of the present invention is further shown. As shown, the fan assembly 10 preferably includes an upper fan head 12 attached to a fan base 14 using mounting bracket 28 and adjustable joint 30. As further shown, the exemplary fan base 14 includes three supporting legs 22 (not shown), 24, 26 which preferably are able to extend out and rotate from connecting joints 27.

As further shown in FIG. 2, the fan head 12 in accordance with a preferred embodiment of the present invention preferably further includes a fan grille 18 which preferably includes an outer fan cover 15 and perimeter shock absorbing ring 20 which preferably extends around the circumference of the outer fan cover 15. As further shown in FIG. 2, in accordance with a further preferred embodiment the fan head 12 may be positioned in an external cage 21 that protects the fan head 12. According to a further preferred embodiment, the fan head 12 is preferably suspended within the cage 21 which is preferably integrally connected to the perimeter shock absorbing ring 20. Further, the back of the fan head 12 is preferably secured to the cage 21 with an impact absorbing mount 38 as shown and discussed further in more detail with reference to FIG. 5 below.

Figure 3:
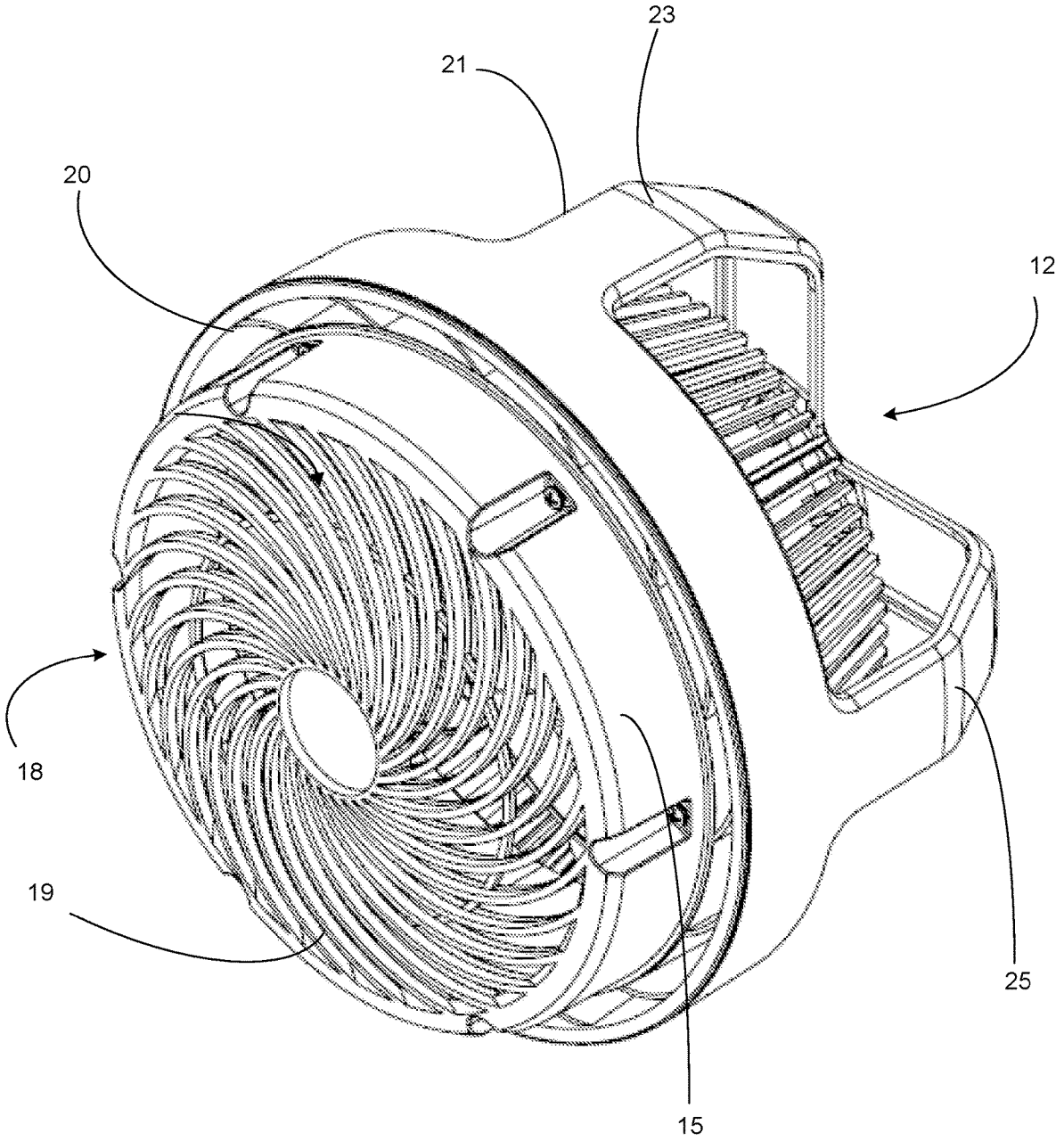
FIG. 3 shows a perspective view of a fan head assembly in accordance with a first preferred embodiment of the present invention.

With reference now to FIG. 3, a perspective view of the fan head 12 is further shown with the face 18, fan veins 19, outer fan cover 15, shock absorbing ring 20 and a cage 21 as discussed above. As further shown, in accordance with a preferred embodiment of the present invention, the cage 21 may preferably be formed from at least a first vertical bracing bracket 23 and a horizontal bracing bracket 25.

Figure 4:
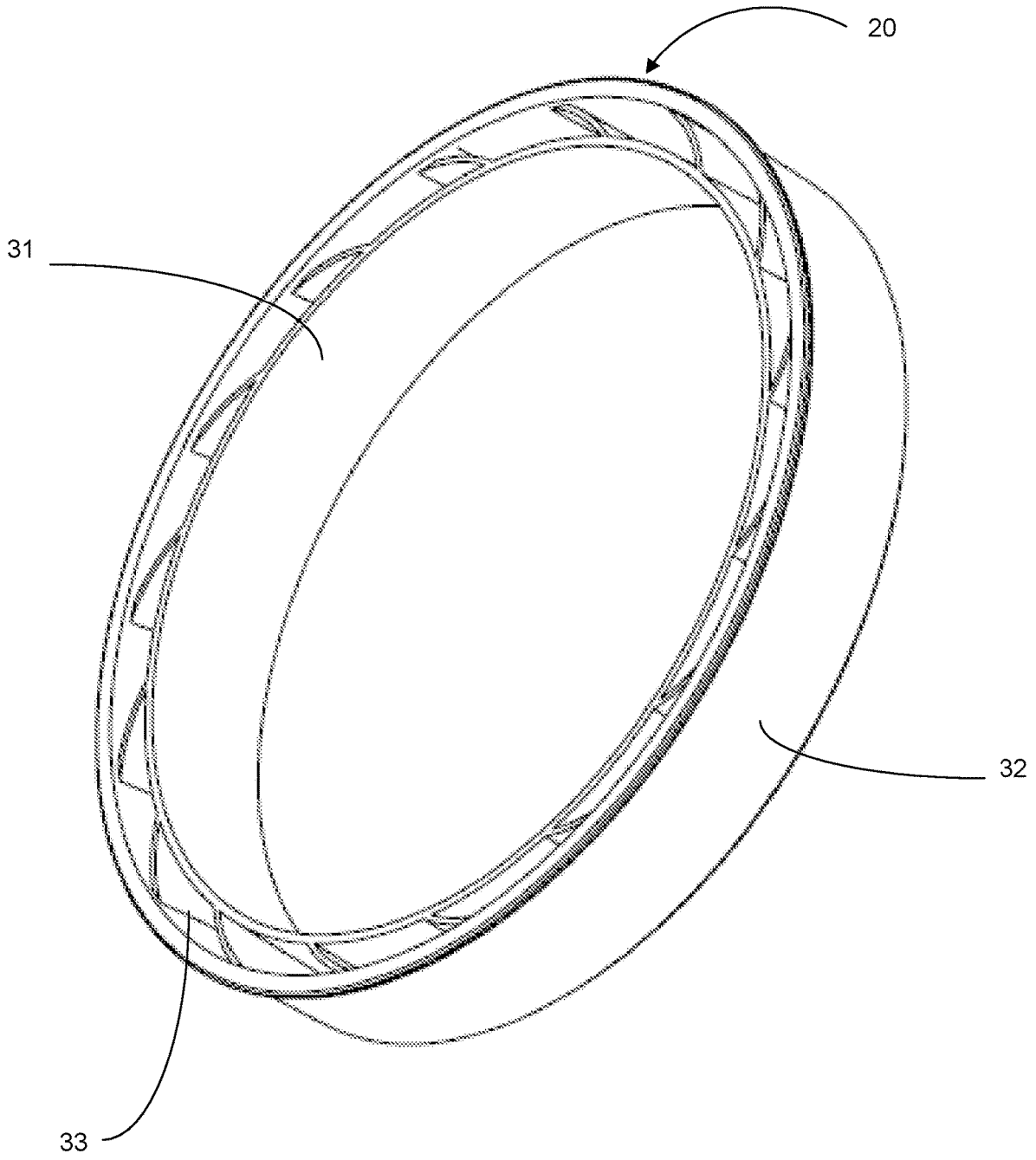
FIG. 4 shows a perspective view of a shock absorbing ring in accordance with a first preferred embodiment of the present invention.

With reference now to FIG. 4, a perspective view of a shock absorbing ring 20 in accordance with a first preferred embodiment of the present invention shall now be discussed. As shown, in accordance with a preferred embodiment of the present invention, the shock absorbing ring 20 may preferably include an inner absorption layer 33 enclosed between an inner surface 31 and an outer surface 32. In accordance with a preferred embodiment, the inner absorption layer 33 may preferably be formed of tangential radial ribs which can flex when absorbing an impact to help protect the fan assembly elements as discussed with respect to FIG. 5 below. In accordance with a further preferred embodiment, the components and layers of the shock absorbing ring 20 may preferably be formed of a variety of injection moldable materials and the like.

Figure 5:
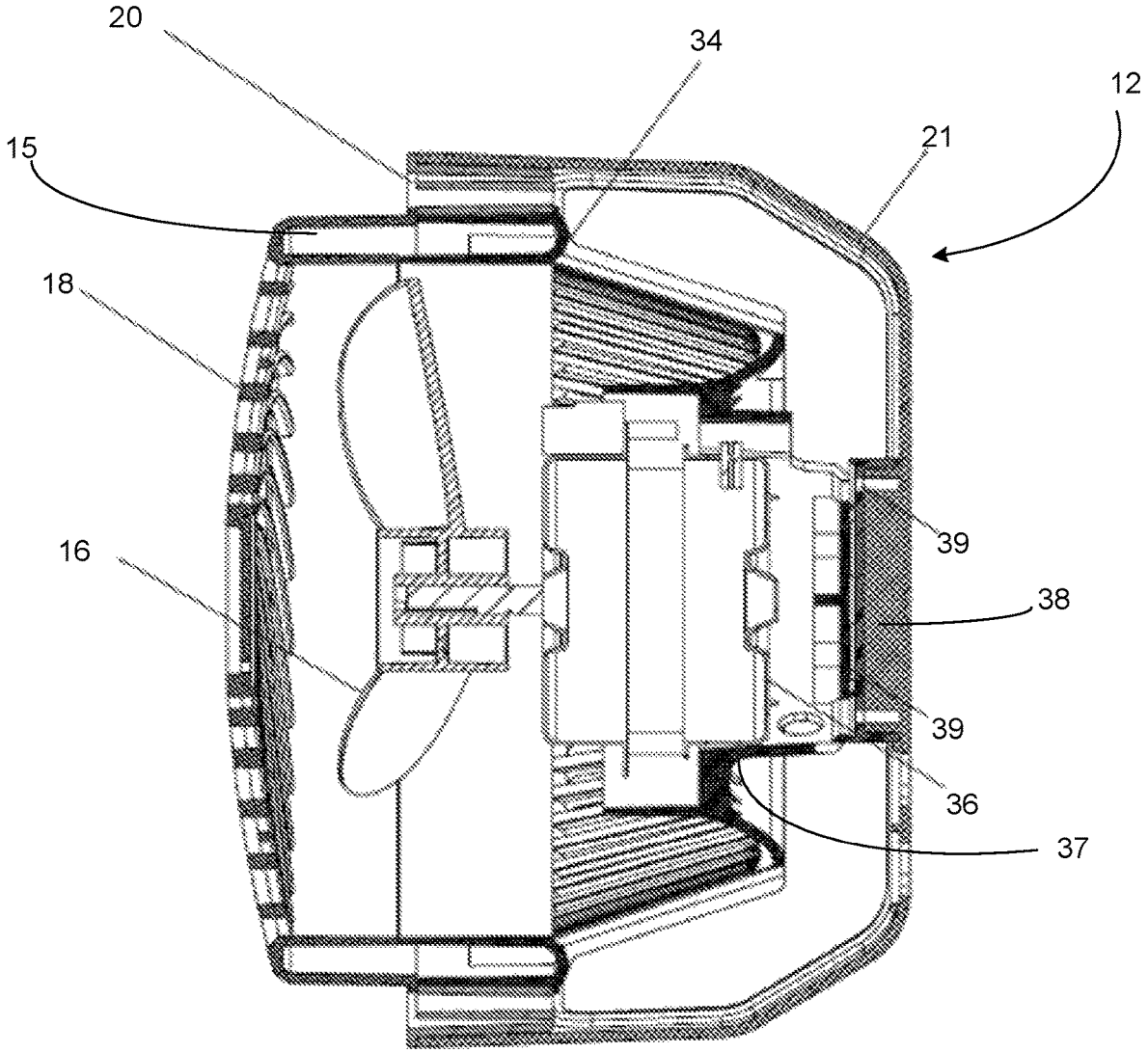
FIG. 5 shows an internal view of a fan head assembly in accordance with a further preferred embodiment of the present invention.

With further reference now to FIG. 5, further aspects of the present invention shall now be discussed. FIG. 5 shows an internal view of an exemplary a fan head assembly 12 of the present invention in accordance with a further preferred embodiment. As shown, the exemplary fan head 12 includes a fan grille 18 and an outer fan cover 15 enclosing fan blades 16 and an inner fan assembly 37 which preferably includes a fan motor 36. As further shown, the outer fan cover 15 is preferably encircled by a shock absorbing ring 20 and cage 21 as discussed above. According to a further preferred embodiment, the fan head assembly 12 may preferably further include a cowl 34 with inlet guarding as well as an impact absorbing mount 38 as discussed further below. According to a further preferred embodiment, the inner fan assembly 37 may preferably be secured to the protective cage 21 using connectors and/or screws 39 which preferably extend through the impact absorbing mount 38. According to further preferred embodiments, the fan assembly 37 of the present invention may preferably be water resistant and may preferably include multiple selectable speeds.

Figure 6:
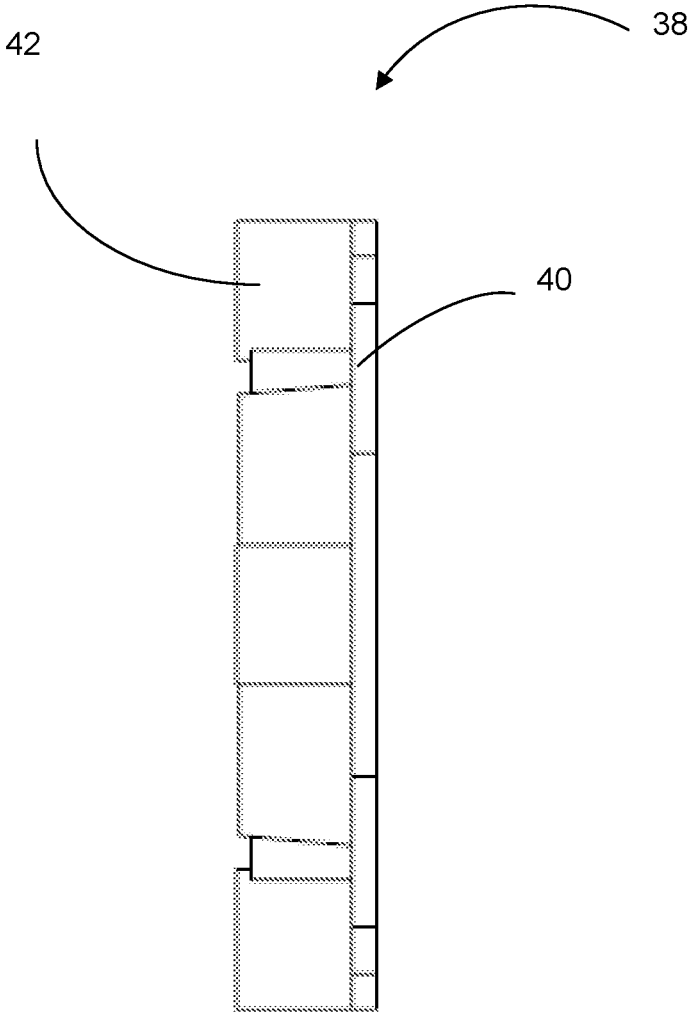
FIG. 6 shows a side view of an impact absorbing mount in accordance with a first preferred embodiment of the present invention.
Figure 7:
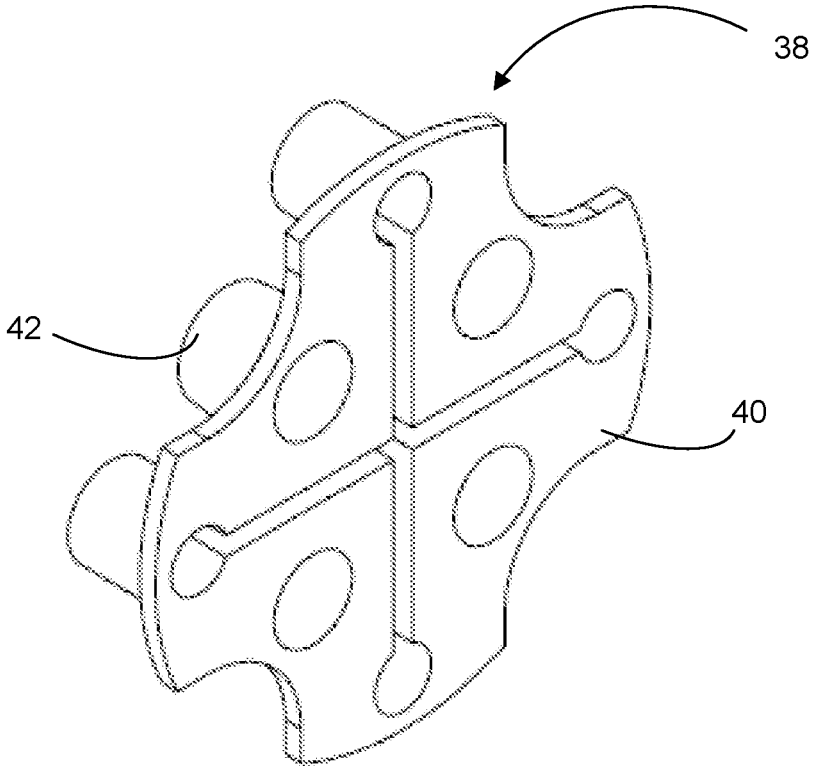
FIG. 7 shows a side, rear perspective view of an impact absorbing mount in accordance with a first preferred embodiment of the present invention.
Figure 8:
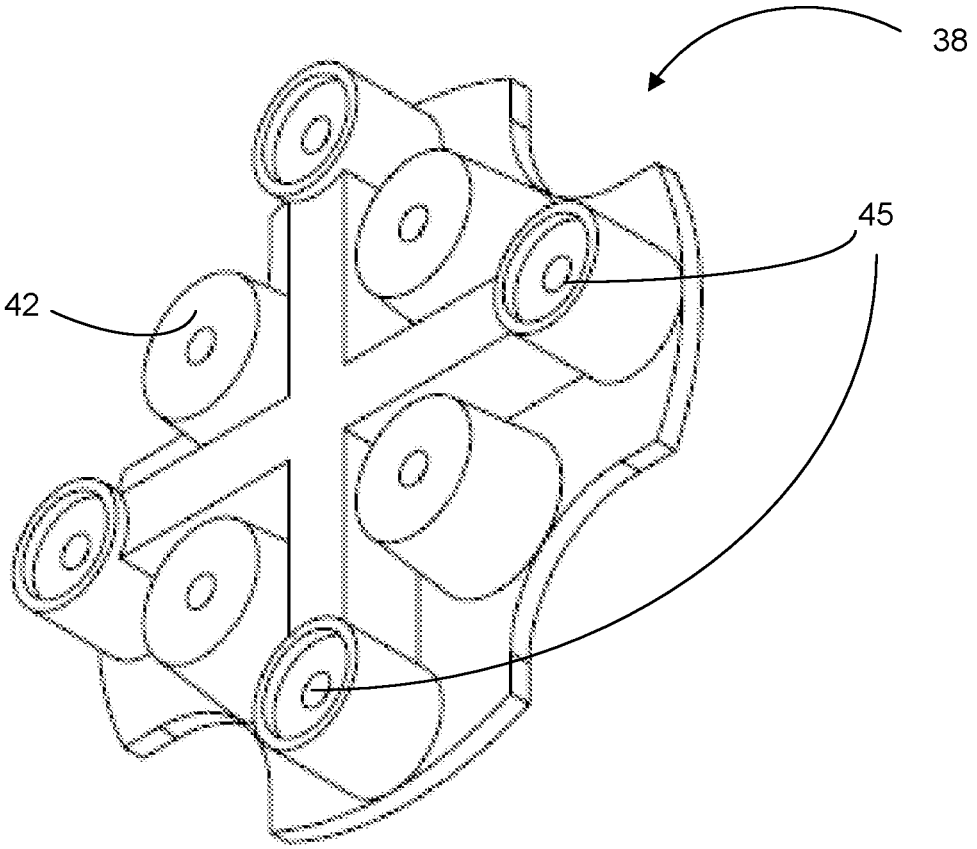
FIG. 8 shows a front perspective view of an impact absorbing mount in accordance with a first preferred embodiment of the present invention.

Referring now to FIGS. 6-8, an exemplary impact absorbing mount 38 in accordance with a first preferred embodiment of the present invention shall now be discussed. As shown in FIG. 6, a side view of an exemplary impact absorbing mount 38 may preferably include raised projections 42 and a rear mounting surface 40. As shown in FIGS. 7-8, the raised projections 42 may be hollow, circular projections. Alternatively, the projections may be of any desired shape or construction. According to a further preferred embodiment, selected raised projections 45 may be perforated to allow for a securing screw (not shown) to extend through to the rear mounting surface 40. According to a further preferred embodiment, the rear mounting surface 40 may preferably be formed of a substantially flat surface. Alternatively, in accordance with alternative preferred embodiments, the rear mounting surface 40 may also include hollow or solid projections.

Figure 9:
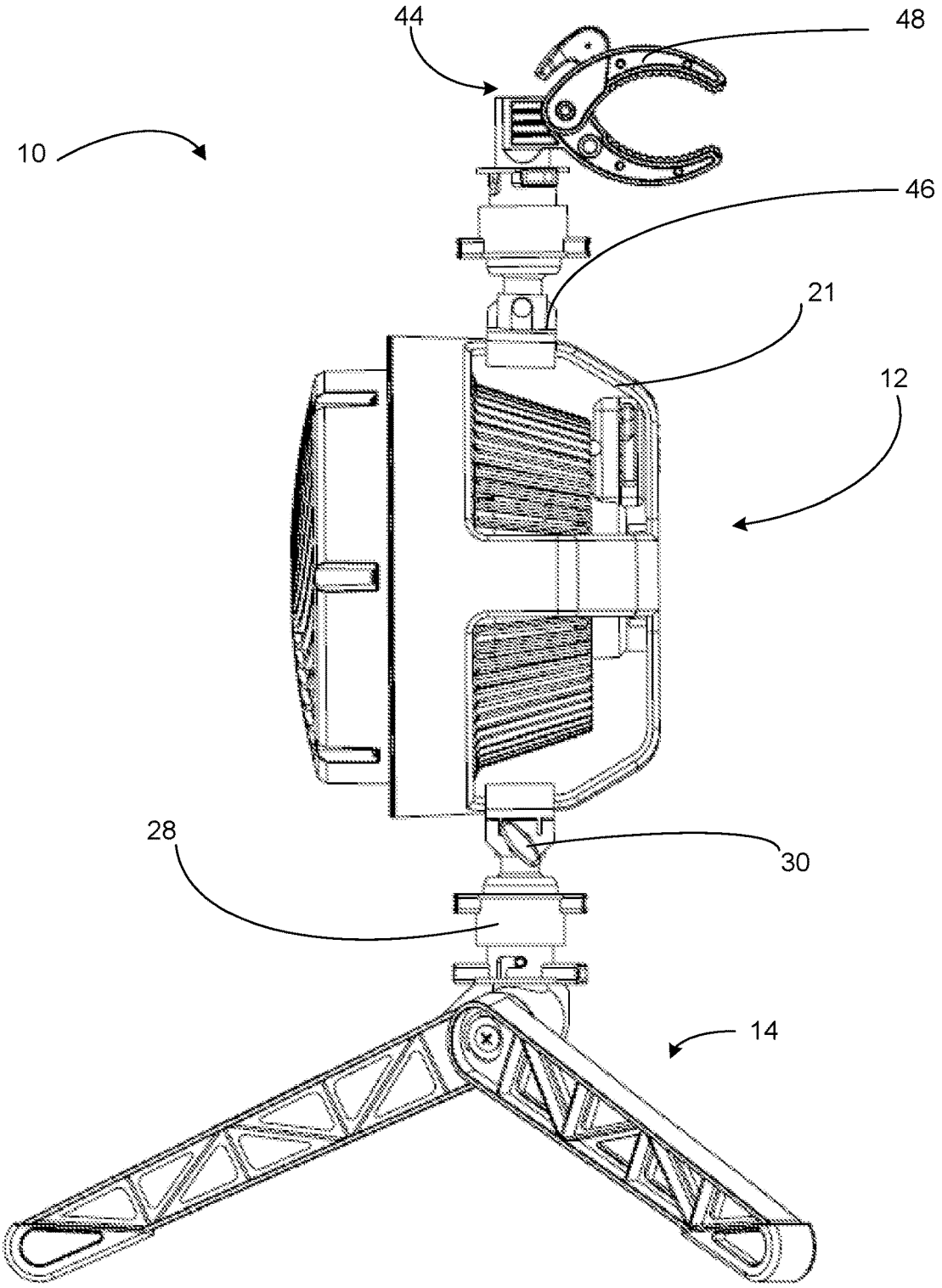
FIG. 9 shows a left side-view of an exemplary fan assembly with a claw clip attachment in accordance with a further preferred embodiment of the present invention.

Referring now to FIG. 9, a further aspect of the present invention shall now be discussed. As shown, FIG. 9 illustrates a left side-view of an exemplary fan assembly 10 (as shown in FIG. 2 above) with a claw clip attachment 44 in accordance with a further preferred embodiment of the present invention. As shown, the exemplary claw clip attachment 44 may preferably include a securing latch 46 for attaching the claw clip attachment 44 to the protective cage 21. Additionally, the exemplary claw clip attachment 44 may further include an adjustable clamp 48 which may preferably include an adjustable locking mechanism for attaching the fan assembly 10 to external objects. According to alternative preferred embodiments, the adjustable clamp 48 may be manually adjustable and/or spring loaded as desired. Preferably, the securing latch 46 may be attached to any of a variety of locations on the fan assembly 10 and the cage 21. According to a further alternative preferred embodiment, the claw clip attachment 44 may preferably be further attachable to the upper fan head 12 via the bayonet mount 28 to the adjustable joint mechanism 30. In this way, the upper fan head 12 may alternatively be secured separate from and without the use of the leg base 14.

The foregoing description of the preferred embodiment of the present invention has been presented for the purpose of illustration and description. It is not intended to be exhaustive or to limit the invention to the precise form disclosed. Many modifications and variations are possible in light of the above teachings. It is intended that the scope of the present invention not be limited by this detailed description, but by the claims and the equivalents to the claims appended hereto. The above described embodiments, while including the preferred embodiment and the best mode of the invention known to the inventor at the time of filing, are given as illustrative examples only. It will be readily appreciated that many deviations may be made from the specific embodiments disclosed in this specification without departing from the spirit and scope of the invention. Accordingly, the scope of the invention is to be determined by the claims below rather than being limited to the specifically described embodiments above.

What is claimed is:

1. An air circulation system, wherein the air circulation system comprises:

a lower fan assembly, wherein the lower fan assembly is comprised of a fan base, wherein the fan base is comprised of a rotatable mount and a plurality of supporting legs, wherein each of the supporting legs is connected to the rotatable mount by a respective connecting joint, wherein each respective connecting joint is configured to allow the respective connected supporting leg to rotate at the respective connecting joint and extend away from the rotatable mount;

an upper fan assembly, wherein the upper fan assembly is comprised of:

an inner fan assembly, wherein the inner fan assembly is comprised of a fan motor;

a plurality of fan blades;

an outer fan cover;

a fan grille, wherein the fan grille is comprised of a plurality of fan veins; a perimeter shock absorbing ring, wherein the perimeter shock absorbing ring extends around a circumference of the outer fan cover, wherein the perimeter shock absorbing ring is comprised of an inner surface, an inner absorption layer, and an outer surface, wherein the inner absorption layer is comprised of a plurality of flexible ribs, and wherein the perimeter shock absorbing ring is comprised of injection moldable materials;

an external cage, wherein the external cage is comprised of a first vertical bracing bracket and a first horizontal bracing bracket, wherein the first vertical bracing bracket and the first horizontal bracing bracket intersect at an intersection area, wherein the upper fan assembly is mechanically connected to the external cage at a point within the intersection area; and an impact absorbing mount, wherein the impact absorbing mount is comprised of a plurality of raised projections and a rear mounting surface, wherein the raised projections are hollow, circular projections, wherein the rear mounting surface is flat, wherein at least one raised projection is perforated to allow for a connector to extend through to the rear mounting surface, wherein the inner fan assembly is secured to the external cage with the connector, wherein the connector extends through the impact absorbing mount; wherein the impact absorbing mount is secured between the external cage and the upper fan assembly; and a mounting bracket, wherein the lower fan assembly is adjustably connected to the upper fan assembly by the mounting bracket, wherein the mounting bracket is further comprised of an adjustable joint, wherein the adjustable joint is configured to allow for tilt adjustment, further wherein the adjustable joint is configured to lock in selected positions, and wherein the mounting bracket is comprised of a bayonet mount.

2. The air circulation system of claim 1, wherein the system is further comprised of a claw clip attachment.

3. The air circulation system of claim 2, wherein the claw clip attachment is further comprised of a securing latch, wherein the securing latch is configured to attach to the external cage.

4. The air circulation system of claim 3, wherein the claw clip attachment is further comprised of an adjustable clamp for attaching the upper fan assembly to external objects.

5. The air circulation system of claim 1, wherein the adjustable clamp is spring loaded.

* * * * *